United States Patent [19]

Guiu et al.

[11] Patent Number: 4,608,900

[45] Date of Patent: Sep. 2, 1986

[54] APPARATUS FOR CUTTING A PIECE AT A BEVEL

[75] Inventors: Claude Guiu, 1, rue Abbé Chanlon, Domois 21600 Longvic; Régis Artru, Fontaine-les-Dijon, both of France

[73] Assignee: Claude Guiu, Longvic, France

[21] Appl. No.: 636,929

[22] Filed: Aug. 2, 1984

[30] Foreign Application Priority Data

Jan. 6, 1984 [FR] France ..... 84 00148

[51] Int. Cl.[4] ..... B27B 21/00

[52] U.S. Cl. ..... 83/766; 83/454; 83/581

[58] Field of Search ..... 83/743, 581, 829, 766, 83/765

[56] References Cited

U.S. PATENT DOCUMENTS

| | | | |
|---|---|---|---|
| 105,752 | 7/1870 | Wilcox | 83/765 |
| 787,230 | 4/1905 | Stuebe | 83/766 |
| 1,458,951 | 6/1923 | Poole et al. | 83/766 |
| 1,541,134 | 6/1925 | Gilpin | 83/766 |
| 1,633,409 | 6/1927 | Hoover et al. | 83/766 |
| 1,855,945 | 4/1932 | Denyer . | |
| 2,598,979 | 6/1952 | Denney . | |
| 2,705,029 | 3/1955 | Ziphel . | |
| 3,767,183 | 10/1973 | Van Gelder . | |
| 3,866,897 | 2/1975 | Whalen, Jr. . | |
| 4,052,046 | 10/1977 | Mortoly . | |

FOREIGN PATENT DOCUMENTS 32476 7/1981 European Pat. Off. .

*Primary Examiner*—Frank T. Yost

*Attorney, Agent, or Firm*—Sandler & Greenblum

[57] ABSTRACT

An apparatus for cutting at a bevel a piece presents a reference surface with respect to which the plane of cut must be inclined, by the desired angle.

The apparatus comprises two parallel, vertical side elements in which are respectively provided two slots for guiding a saw blade, these two slots being parallel and opening in the edges of the side elements to define the plane of cut. Means are provided for connecting the two parallel, vertical side elements to maintain them at a distance from each other along a common transverse axis. A support is mounted on each side element so as to be orientable about the transverse axis and presents an upper bearing face. The two parallel, upper bearing faces define a bearing plane for the reference surface of the piece to be cut. Means are provided for blocking each support on the side element associated therewith so that its bearing face forms with the slot of the corresponding side element, an angle equal to the desired angle of cut.

26 Claims, 12 Drawing Figures

35
34
32b
33b
47
33
y
42
11
46
37a
45
43
44
37
x
36a
37d
32
32a
38
39
41
36b
36d
36

56
57
48
51
37a
36a
x
x
x
y
37d
36c
37c
59
36b
36
58a
37
37b 56
57
55
52
48
51
53
54
49

APPARATUS FOR CUTTING A PIECE AT A BEVEL

BACKGROUND OF THE INVENTION

1. Field of the Invention

The present invention relates to an apparatus for cutting a strip of material such as a plank, a moulding, and like piece at a bevel.

2. Discussion of Background Information

A miter box is conventionally used to cut elongated pieces, such as mouldings intended to form a frame, at a bevel. Typically, mitre boxes generally have a U-shaped cross section the lateral walls of which are pierced right through with coplanar slots defining several planes of cut inclined at various angles with respect to the longitudinal axis of the mitre box. These mitre boxes generally enable cuts to be made at angles of 30, 45 or 90° with respect to the longitudinal axis of the piece being cut.

Such mitre boxes, however, have various drawbacks. Firstly, the values of the angles at which the cuts may be made are limited and predetermined. In other words, it is impossible to cut a piece along a plane of cut forming with the reference plane an angle other than the angles predetermined by the slots of the mitre box i.e., 30, 45 or 90°. Furthermore, conventional mitre boxes have a fixed, relatively thin width, which limits their use to the cutting of relatively narrow pieces such as mouldings.

SUMMARY OF THE INVENTION

The present invention relates to an apparatus for adjusting the angle of cut with respect to a reference plane and for cutting pieces of variable width, as desired.

To this end, this apparatus of the present invention for cutting a piece presenting a reference surface at a bevel of a desired angle with respect to which the plane of cut must be inclined is characterized in that it includes two parallel, vertical side elements in which are respectively provided two slots for guiding a saw blade, these two slots being parallel and opening in the edges of the side elements to define the plane of cut, means for connecting the two parallel, vertical side elements to maintain them at a distance from each other along a common transverse axis, a support mounted on each side element so as to be orientable about the transverse axis and presenting an upper bearing face, the two parallel, upper bearing faces defining a bearing plane for the reference surface of the piece to be cut, and means for blocking each support on the side element associated therewith so that its bearing face forms with the guide slot of the corresponding side element, an angle equal to the desired angle of cut.

According to a further feature of the invention, the means for connecting the two parallel, vertical side elements are provided to allow a mutual displacement of the two side elements one in the direction of the other, with a view to ensuring tightening and blocking of the piece to be cut between the opposite faces of the two side elements. These connecting and tightening means are advantageously constituted by a threaded rod mounted to rotate and blocked in translation in one of the side elements and which is screwed in a tapping provided in the other side element.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
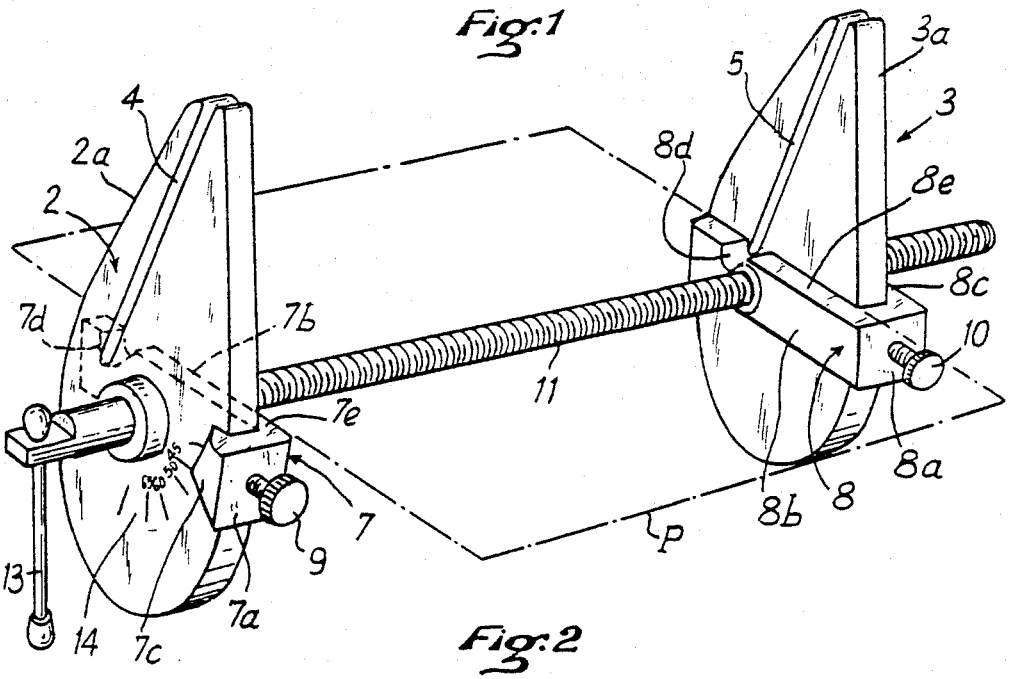
FIG. 1 is a view in perspective of a cutting apparatus according to the invention.

Referring now to the drawings, the apparatus shown therein is intended for cutting at a bevel a piece 1 which may be constituted by a plank, a moulding, and the like of any width. The apparatus essentially comprises two parallel, vertical side element 2,3 between which the piece 1 to be cut extends. These side element 2,3, of reduced thickness, present a periphery of any form defined by their respective edges 2*a*,3*a*. In these side elements 2,3, are respectively provided slots 4,5 parallel to each other and which open out in edges 2*a*, 3*a*. These slots are intended to guide a saw blade 6 during the bevel-cut operation.

The piece 1 to be cut bears on two support 7,8 mounted to rotate on the respective side element 2,3 about a common transverse axis xy. The support 7,8 may be constituted by fork joints comprising webs 7*a*,8*a* parallel to edges 2*a*,3*a* of side element 2,3 and in which are screwed locking screws 9,10 whose tips may come into contact with the edges 2*a*,3*a*. The webs 7*a*,8*a* are extended, on the inside, i.e. in the space between the two side elements 2,3, by long flanges 7*b*,8*b* and, outside, by much shorter flange 7*c*, 8*c*. In this way, each of the fork-joint shaped support 7,8 covers to a certain extent the side element 2,3 associated therewith. The long inner flanges 7*b*,8*b* are transversed by a threaded rod 11 materializing the common transverse axis xy. These flanges 7*b*,8*b* present, on their respective upper face 7*e*, 8*e*, notches 7*d*, 8*d* for engagement therein of the lower cutting edge of the saw blade 6.

Figure 2:
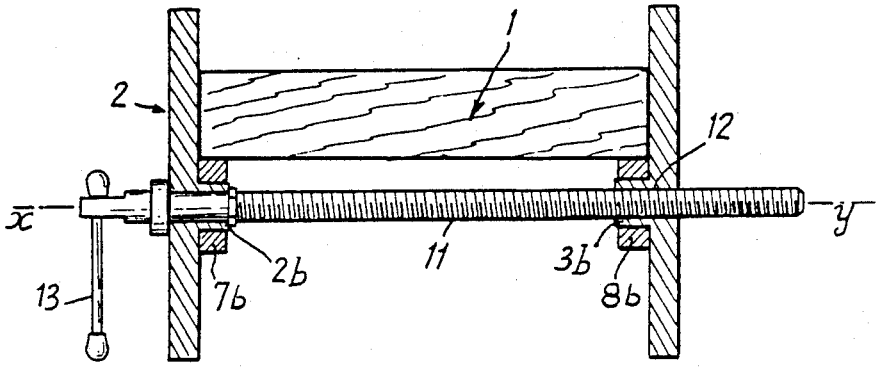
FIG. 2 is a view in transverse section of the apparatus through the axis of the blocking rod.

As may be seen in FIG. 2, the inner flanges 7*b*,8*b* of the respective supports 7,8 are mounted to rotate on inner hubs 2*b*, 3*b*, i.e. ones facing each other, of the two side elements 2,3. The threaded rod 11 which passes through these hubs 2*b*,3*b* is mounted in one of the side elements, in the present case in side element 2, being blocked in translation with respect thereto, while this threaded rod is screwed in a tapped hole 12 made right through the other side element 3. A manoeuvring handle 13 is provided at one of the ends of the threaded rod 11.

Furthermore, as may be more readily seen in FIG. 1, the outer flanges 7*c*, 8*c* of the respective supports 7,8 constitute indices movable opposite circular graduations 14 marked on the outer faces of side element 2,3.

To cut transversely at a predetermined angle—a through a piece 1 such as a plank, to form a bevel, the supports 7,8 are firstly oriented in a position such that their upper bearing faces 7*e*, 8*e* make with the guide slots 4,5, an angle—a corresponding to the angle desired for the bevel cut of piece 1. This orientation is obtained by displacing the short flanges 7*c*,8*c* forming index opposite the circular graduations 14 and by blocking the supports 7,8 by means of screws 9,10 in the appropriate positions corresponding to the desired angle—a. The upper faces 7*e*, 8*e* of the supports 7,8 thus define a substantially horizontal bearing plane P (FIGS. 1 and 3) for the piece 1 to be cut. The piece 1 to be cut is then placed between the two side elements 2,3 and is tightened between these two side elements by rotating the threaded rod 11 by means of handle 13 so as to bring the two side elements 2, 3 mutually closer to each other until they tighten therebetween the edges of the piece 1, as may be seen in FIG. 2.

Once the piece 1 is blocked in this way, it is then easy to engage the saw blade in the two guide slots 4,5 and to saw the piece 1 transversely, along the plane of cut P1 (FIGS. 1 and 3) which is inclined, with respect to the bearing plane P, by the angle—a determined by the relative position of the guide slots 4,5 and the supports 7,8.

From the foregoing, it is seen that the appartus according to the invention makes it possible to cut the piece 1 at an angle—a of any value. Furthermore, the apparatus enables pieces 1 of any width to be cut, since the two sides elements 2,3 may be more or less distant from each other.

Figure 4:
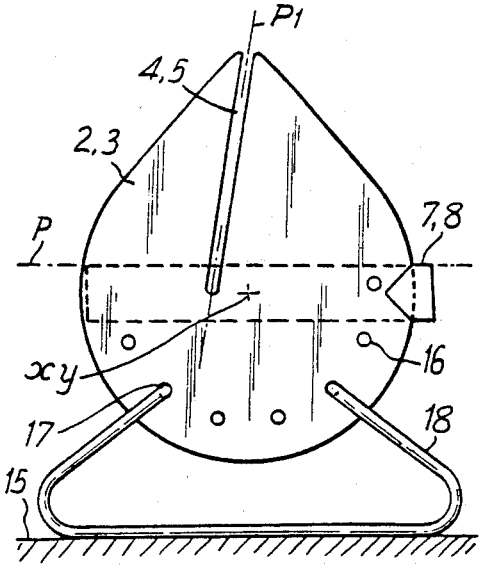
FIGS. 4 and 5 are views in elevation of various embodiments of the feet of the side elements.
Figure 5:
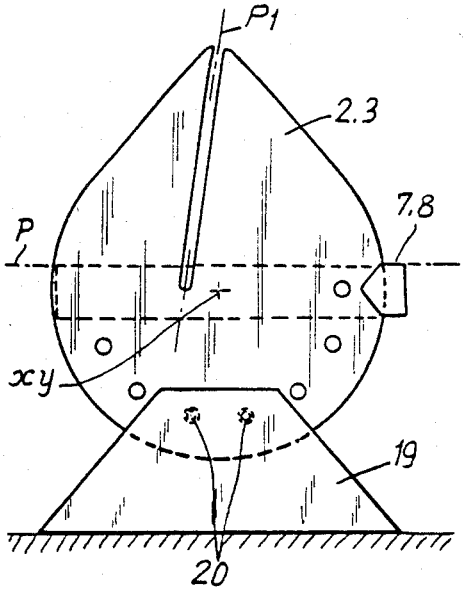

FIGS. 4 and 5 illustrate various embodiments of the feet which may be associated with the side elements 2,3 to enable them to abut on an appropriate plane 15 during the cutting operation.

In the embodiments illustrated in FIG. 4, each of the side elements 2,3 is pierced, in its lower part opposite slots 4,5, with a succession of holes 16 distributed over an arc of circle centred on the transverse axis xy and in which are engaged the bent ends 17 of feet 18 made of metal wire or like material. It is possible, by an appropriate choice of the two holes 16 in which the bent ends 17 are engaged, to arrange for the supports 7,8 and the piece 1 to be cut to be substantially horizontal during the cutting operation, as illustrated in FIG. 4.

FIG. 5 illustrates a variant embodiment in which each foot 19, constituted by a vertical plate of trapezoidal form, for example, is rendered fast with the side element 2,3 associated therewith by means of connecting members 20 such as balls, engaged in two corresponding holes 16 in the side element 2 or 3.

Figure 6:
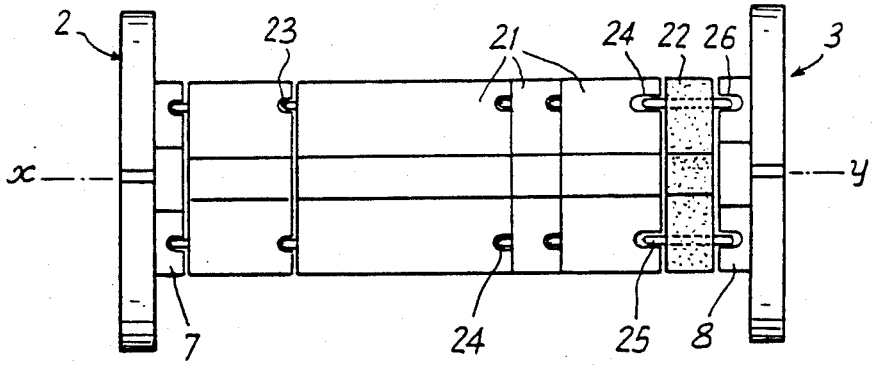
FIG. 6 is an overall longitudinal view of a variant of the apparatus comprising intermediate shims.
Figure 7:
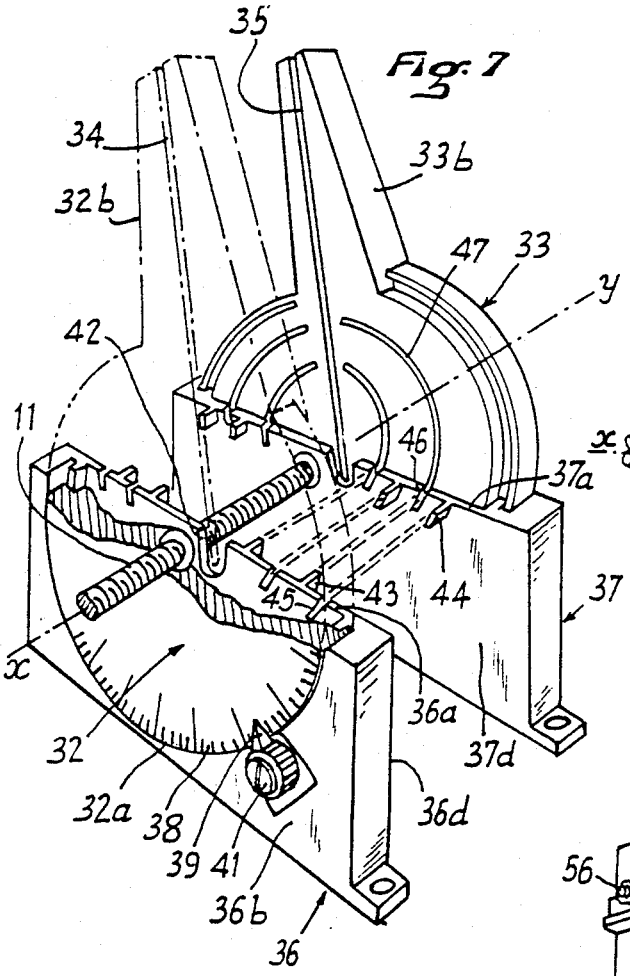
FIG. 7 is a view in perspective of cutting another variant of the apparatus according to the invention.
Figure 8:
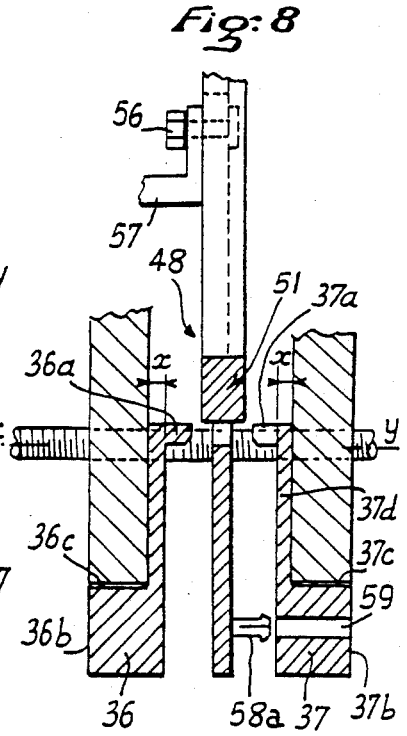
FIG. 8 is a view in transverse section of the apparatus provided with the intermediate shim between the two supports and the two side elements, before said shim is positioned on one of the supports.

FIG. 6 illustrates an adaptation of the apparatus according to the invention where it is desired to maintain a substantially constant width between the two side elements 2,3 for repetitive work, while maintaining tightening. To this end, rigid intermediate shims 21 are disposed between the two side elements 2,3 so as to extend over the in part space provided between these two side elements, together with, an elastic shim 22 to ensure tightening. The shims 21 may have different widths so as to enable the apparatus to be pre-adjusted for various work widths. All the rigid shims 21 and the elastic shim 22 are pierced with a central hole for the tightening and blocking rod 11 to pass. These shims also preferably present catches 23, on their frontal faces, which engage in corresponding patches 24 provided in the other frontal face of the adjacent shim. Shims 21 thus remain lightly fitted in one another, of in addition to engaging the catches 23 in the notches 24, when the apparatus is loosened and the elastic shim 22 is relaxed. Special catches 25 extend through the elastic shim 22 and are engaged in notches of the adjacent elements and more particularly of the adjacent rigid shim 21 and possibly in notches 26 provided in one of the adjacent supports 7,8.

The cutting apparatus shown in FIGS. 7 to 12 makes it possible to cut pieces of various shapes such as a plank (FIG. 11) or a corner moulding 31 (FIG. 12), of any width. The apparatus essentially comprises two parallel vertical side elements 32,33 between which the piece to be cut extends and is maintained tightend. Each of these side elements 32,33 comprises a circular part 32*a*, 33*a* extended, over part of its periphery, by an outwardly extending arm 32*b*, 33*b*, the two circular parts being adapted to rotate about the same common axis xy. Furthermore, slots 34,35 for guiding a saw blade, parallel to each other, are made in the central circular part 32*a*, 33*a* and in the corresponding arm 32*b*,33*b* of the two side elements 32,33.

The two side elements 32,33 are mounted to rotate on respective supports 36,37 constituted by two parallel vertical plates, of rectangular form, respectively presenting upper horizontal bearing face 36*a*,37*a* for the piece to be cut. The two support plates 36,37 which may be fixed, in their lower part, on a table or a workbench, also present, in their outer faces 36*b*,37*b*, semicircular recesses 36*c*, 37*c* in which the circular parts 32*a*,33*a* of the two rotatable side elements 32,33 are respectively housed.

The two support plates 36,37 bearing the two associated rotatable side elements 32,33 are connected to each other via the threaded rod 11 materializing the common transverse axis xy about which the two side elements 32, 33 rotate. This threaded rod 11 is mounted to rotate in one of the support plates, for example the plate 37, while being locked in translation with respect thereto, whereas this threaded rod is screwed in a tapped hole pierced right through the other support plate 36. The two side elements 32,33 are mounted to rotate freely about the common axis xy, on their respective support plates 36,37, and they may be blocked on these support plates in any desired angular position with respect to these plates, in which position the guide slots 34,35 make, with the upper bearing faces 36*a*,37*a* of the support plates 36,37, an angle at which the bevel cut is to be made.

In order to enable the angle of cut to be easily located, each of the side elements 32,33 presents, on its outer face and along its periphery, a circular graduated scale 38 moving in front of an index 39 fast with a locking button 41 borne by the corresponding support plate. This button 41 makes it possible to block the corresponding side element in the desired angular position when the index 39 is placed opposite the desired graduation of the scale 38 borne by the side element. In the upper horizontal bearing faces 36*a*,37*a* of the support plates 36,37 there are provided cut-outs 42 which are always aligned, if viewed in a direction parallel to the common axis of rotation xy, with the end parts of the slots 34,35 for guiding the saw blade. The two cut-outs 42 lies in the immediate vicinity of the threaded rod 41 which materializes the axis of rotation xy.

The support plates 36,37 present, in the upper part of their inner faces 36*d*,37*d*, respective supports 43,44 whose upper surfaces are flush with the horizontal bearing faces 36*a*, 37*a* and which are constituted by horizontal tongues extending transversely, i.e. parallel to axis xy. The bearing tongues 43 of the support plate 36 extend in the direction of the other support plate 37 and, inversely, the bearing tongues 44 of this support plate 37 extend in the direction of the other support plate 36. In the axis of these tongues 43,44 there are provided, in the opposite support plate, slots in which these bearing tongues 43,44 may engage, namely slots 45 made in the upper part of the inner face 36*d* of the support plate 36 and which open out in the upper bearing surface 36*a*, and slots 46 made in the upper par of the inner face 37*d* of the support plate 37 and which opens out in the upper bearing surface 37*a*.

Opposite the slots 45,46, the two side elements 32,33 present, on their opposite inner faces, circular grooves 47 which are centered on the axis of rotation xy of the two side elements.

From the foregoing description, it is seen that it is possible to tighten a piece to be cut such as a plank I, between the two side element 32, 33, as long as these pieces have a width greater than 2x, x being the with of the upper horizontal bearing surfaces 36*a*, 37*a* defined by the recesses 36*c*, 37*c* on the one hand and the inner faces 36*d*, 37*d* on the other hand. The tongues 43, 44 which extend transversely, contribute to supporting the pieces which are to be cut and if these pieces are of small width, they engage in the slots 45, 46 and possibly in the grooves 47 of the side elements 32, 33.

Figure 9:
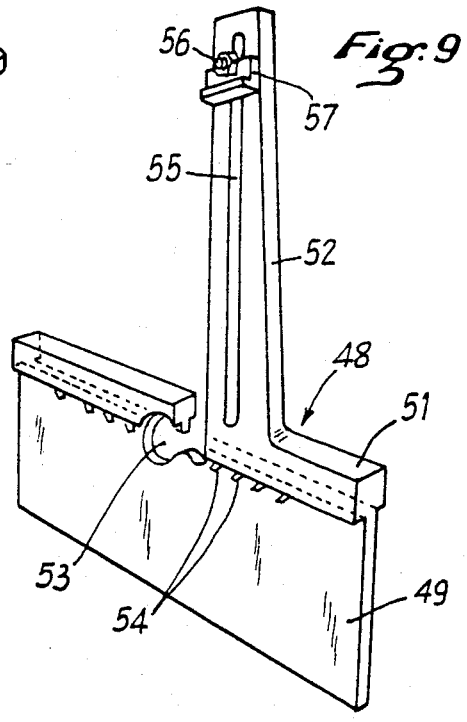
FIG. 9 is a view in perspective of the intermediate shim of FIG. 9.

If the pieces to be cut has a width less than the value 2x mentioned above, it is necessary to resort to an intermediate shim 48 as shown in FIG. 9. The shim 48 comprises a vertical web 49 of small thickness, adapted to be housed between the two support plates 36, 37 and which is connected, in its upper part, to a horizontal base 51 of square or rectangular section which is in turn extended upwardly by a vertical arm 52. The upper part of the web 49 and the base 51 present a cut-out 53 of appropriate form making it possible to engage the intermediate shim 48 on the threaded rod 11, when this shim is used. Furthermore, slots 54 are provided in the upper part of the web 49 just below the base 51 to allow the engagement, in these slots, of the bearing tongues 43, 44 borne by the support plates 36, 37. The positions of the slots 54 and their number correspond respectively to those of the bearing tongues 43, 44. Furthermore, arm 52 presents a vertical slot 55 in which may slide a bolt 56 ensuring blocking of a stop 57 constituted by a small angle iron. The slot 56 presents two parts of different width, namely a part 56*a* of relatively large width in which the head of the bolt 56 slides and a narrower part 56*b* in which the rod of this bolt slides.

Figure 10:
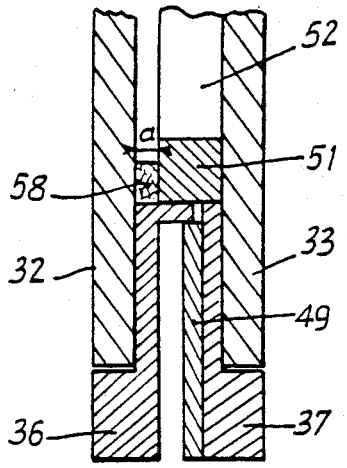
FIG. 10 is a view in transverse section of the apparatus of FIG. 7 and of the intermediate shim in position for cutting pieces of small width at a bevel.
Figure 11:
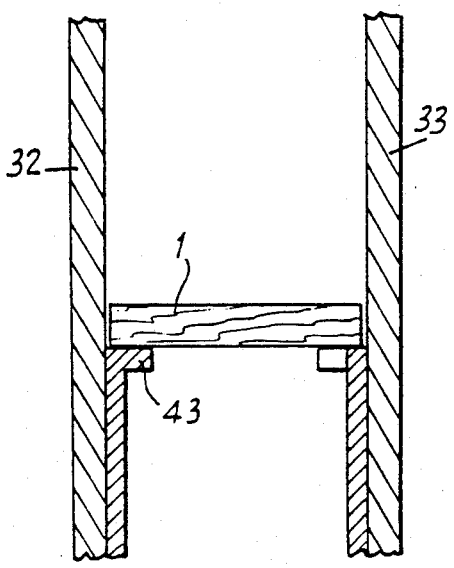
FIG. 11 is a view in transverse section of the apparatus used for cutting a flat piece.

FIG. 10 illustrates the use of the intermediate shim 48 for cutting a bar 58 of width a less than 2x, at a bevel. In this case, the intermediate shim 48 is mounted on one of the support plates, for example the support plate 37. The intermediate shim 48 is applied against the inner face 37*d* of this support plate 37, with the bearing tongues 44 of this support plate engaging in the slots 54 of the web 49 of the intermediate shim. The intermediate shim may be maintained in connection with the web 49 by stud 58*a* and perpendicular thereto, this stud engaging by force in a hole 59*a* made in the lower part of the support plate 37, parallel to axis xy. The base 51 of this shim abuts on the upper horizontal surface 37*a* of the support plate 37 and the piece 58 is in that case tightened between the opposite side element 32 and the vertical face opposite the base 51.

Figure 12:
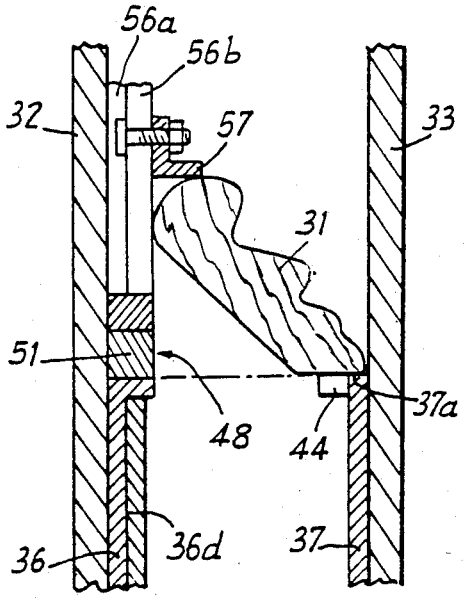
FIG. 12 a view in transverse section of the apparatus used for cutting a corner moulding at a bevel.

FIG. 12 illustrates the use of the intermediate shim 48 for cutting a corner moulding 31 at a bevel. In this case, this moulding 31 is maintained inclined between the upper bearing surface 37*a* and the bearing tongues 44 of the support plate 37 and the stop 57 of the intermediate shim 48 which is then applied against the inner face 36*d* of the opposite support plate 36. The upper stop 57 is blocked in the appropriate position corresponding to the dimensions and shape of the corner moulding 1 having to be cut.

What is claimed is:

1. An apparatus for positioning a piece of material to be cut comprising:

(a) at least one and another guide elements, each said guide elements having an inner face and an outer face defined by a central area and a peripheral edge provided with a guide slot extending radially from the central area, the guide slot in one of the guide elements being aligned with respect to the guide slot in another of the guide elements along a common plane transverse to said guide element;

(b) means for connecting said guide elements in a parallel, spaced-apart relationship along a common transverse axis so as to allow a mutual displacement of one of the guide elements in a direction of another of the guide elements for tightening a piece to be cut between opposite inner faces of said guide elements;

(c) a support operably associated with each of said guide elements having an upper bearing surface, each said guide slot and each said bearing surface adapted to be oriented about said transverse axis relative to each other; and (d) means for locking said guide elements with respect to said support so that each said bearing surface forms an angle, respectively, with respect to each said guide slot corresponding to the desired angle of cut.

2. Apparatus in accordance with claim 1, wherein said means for connecting includes a rod mounted at one end for rotation in an aperture in one of said elements, said rod being threaded at another end and adapted to be screwed through a tapped aperture in another of said elements.

3. Apparatus in accordance with claim 2, wherein said inner face is provided with a hub surrounding said aperture and said support extends across said inner face and is attached to said hub.

4. Apparatus in accordance with claim 3, wherein said upper bearing surface is provided with at least one notch to receive a lower cutting edge of a saw blade.

5. Apparatus in accordance with claim 4, wherein said means for locking includes a fork joint having a locking screw for contacting said guide elements, said fork joint being connected at one side to said support.

6. Apparatus in accordance with claim 5, wherein said means for locking further includes a flange having a length extending over a portion of the outer face of said elements for a distance shorter than the distance over which the support extends across said inner face.

7. Apparatus in accordance with claim 6, wherein said span is provided with a central tapped opening for receiving said locking screw.

8. Apparatus in accordance with claim 7, wherein said flange is adapted to constitute a moveable index.

9. An apparatus according to claim 5, wherein each of said elements is pierced in its lower part opposite said guide slot with a succession of holes distributed over an arch of a circle centered on the transverse axis of said circle, said holes engaging a support stand.

10. An apparatus according to claim 9, wherein each said support stand comprises a metal support element having two bent ends engaged in two of the holes of said guide elements.

11. An apparatus according to claim 9, wherein each said support stand further comprises a plate which is fixed to said support element by means of connecting members engaged in at least two of said holes in said support element.

12. An apparatus according to claim 4, wherein said means for maintaining further comprises rigid intermediate shims disposed between said elements so as to extend over at least a portion of space provided between said guide elements and an additional elastic shim for permitting relative movement of said guide elements to allow tightening, said rigid shims and said elastic shim being pierced with a central hole for positioning on said rod.

13. An apparatus according to claim 4 wherein each of said guide elements are mounted to rotate respectively on said support.

14. An apparatus in accordance with claim 13, wherein a part of said edge defines a sector-shaped portion of said central area and another part of said edge defines an outwardly extending portion of said central area.

15. An apparatus in accordance with claim 14, wherein said sector-shaped portion is adapted for rotation about a common axis with said rod, and each said slot extends from said sector-shaped portion radially through said outwardly extending portion.

16. An apparatus in accordance with claim 15, wherein said support is a plate having a recess for housing said sector-shaped portion of the central area.

17. An apparatus in accordance with claim 16, wherein said plate has an outer and an inner face and said recess is in the outer face of said plate.

18. An apparatus according to claim 17, wherein each of said guide elements has a circular graduated scale on said outer face around said edge and said support is provided with an index attached to a locking button borne by the support plate in which said guide element is housed.

19. An apparatus according to claim 17 wherein said plate has an upper bearing surface provided with at least one cut-out aligned in a direction parallel to the common axis of rotation with said guide slot the.

20. An apparatus according to claim 19, wherein each said inner face is provided with a tongue having an upper surface which is flush with the bearing surface of the support plates, each said tongue extending parallel to the common axis of rotation in the direction of the other support plate.

21. An apparatus in accordance with claim 20, wherein said inner face of said support plate is provided with patches is adapted to engage a tongue of the other support plate.

22. An apparatus is accordance with claim 21, wherein said guide elements each have an inner face provided with circular grooves which are centered on a common axis of rotation.

23. An apparatus according to claim 16 further comprising an intermediate shim including a web adapted to be maintained between said support plates and which is joined to a horizontal base adapted to be positioned on the bearing surface of a support plate.

24. An apparatus according to claim 23, wherein the intermediate shim has a base portion provided with a cut-out for engaging the threaded rod.

25. An apparatus according to claim 23, wherein the web of the intermediate shim has an upper part having slots for engaging said tongue.

26. An apparatus according to claim 23, wherein the intermediate shim has an arm extending upwardly from said base portion, said arm having a slot for receiving a bolt for securing pieces to be cut which have a narrow width.

* * * * *

UNITED STATES PATENT AND TRADEMARK OFFICE

CERTIFICATE OF CORRECTION

PATENT NO. : 4,608,900

DATED : September 2, 1986

INVENTOR(S) : Claude GUIU et al.

It is certified that error appears in the above-identified patent and that said Letters Patent is hereby corrected as shown below:

Column 1, line 9, change "piece" to ---pieces--- after "and like";
Column 1, line 11, change "miter" to ---mitre---; and
column 1, line 38, change "this" to ---the--- before "apparatus of the present".

Figure 3:
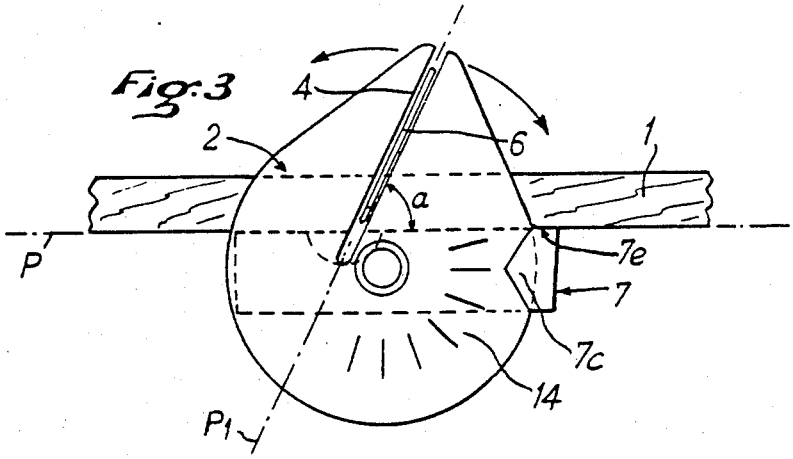
FIG. 3 is a view in elevation of the apparatus during a sawing operation.

Column 2, line 29, insert ---is--- after "Fig. 12";
column 2, line 39, change "element" to ---elements--- after "These side";
column 2, line 43, change "These" to ---As shown in Fig. 3, these--;
column 2, line 46, change "support" to ---supports--- before "7,8";
column 2, line 47, change "element" to ---elements--- after "respective side";
column 2, line 48, change "support" to ---supports--- before "7,8";
column 2, line 56, change "support" to ---supports---; and
column 2, line 57, change "element" to ---elements---.

column 3, line 9, change "element" to ---elements--- before "2,3";
column 3, line 36, change "appartus" to ---apparatus--- after "the"; and
column 3, line 68, change "over the in part the space" to ---over, in part, the space---.

Column 4, line 1, delete the "," after "with";
column 4, line 8, change "patches" to ---notches--- after "corresponding";
column 4, line 10, delete "of" before "in addition"; and
column 4, line 23, change "tightend" to ---tightened---.

UNITED STATES PATENT AND TRADEMARK OFFICE

CERTIFICATE OF CORRECTION

PATENT NO. : 4,608,900

DATED : September 2, 1986

INVENTOR(S) : Claude GUIU et al.

It is certified that error appears in the above-identified patent and that said Letters Patent is hereby corrected as shown below:

Column 5, line 1, insert ---,--- after "37";
column 5, line 5, change "lies" to ---lied" after "42";
column 5, line 21, change "par" to ---part---;
column 5, line 30, change "element" to ---elements---;
column 5, line 31, change "with" to ---width---; and
column 5, line 39, change "pieces" to ---piece---.

Column 6, line 23, insert ---of--- after "each" before "said guide elements".

Column 8, line 25, delete "is" after "notches"; and
column 8, line 25, change "patches" to ---notches---.

Column 8, line 16, "said guide slot the". should read -- said guide slot. --.

Signed and Sealed this

Twenty-fourth Day of November, 1987

*Attest:*

*Attesting Officer*

DONALD J. QUIGG

*Commissioner of Patents and Trademarks*